US009966008B2

(12) United States Patent
Kim

(10) Patent No.: US 9,966,008 B2
(45) Date of Patent: May 8, 2018

(54) PIXEL CIRCUIT AND ORGANIC LIGHT EMITTING DISPLAY DEVICE INCLUDING THE SAME

(71) Applicant: Samsung Display Co., Ltd, Yongin-si, Gyeonggi-do (KR)

(72) Inventor: Sung-Hwan Kim, Osan-si (KR)

(73) Assignee: SAMSUNG DISPLAY, CO., LTD. (KR)

( * ) Notice: Subject to any disclaimer, the term of this patent is extended or adjusted under 35 U.S.C. 154(b) by 0 days. days.

(21) Appl. No.: 15/394,306

(22) Filed: Dec. 29, 2016

(65) Prior Publication Data

US 2017/0193896 A1 Jul. 6, 2017

(30) Foreign Application Priority Data

Dec. 30, 2015 (KR) ..... 10-2015-0189236

(51) Int. Cl.
*G09G 3/04* (2006.01)
*G09G 3/325* (2016.01)

(52) U.S. Cl.
CPC ..... *G09G 3/325* (2013.01); *G09G 2310/08* (2013.01); *G09G 2320/043* (2013.01); *G09G 2330/12* (2013.01)

(58) Field of Classification Search
USPC ..... 345/174
See application file for complete search history.

(56) References Cited

U.S. PATENT DOCUMENTS

| | | | | |
|---|---|---|---|---|
| 7,324,101 | B2 * | 1/2008 | Miyazawa | G09G 3/325 345/204 |
| 8,334,825 | B2 | 12/2012 | Kim | |
| 9,508,759 | B2 * | 11/2016 | Kimura | G09G 3/3233 |
| 2006/0022305 | A1 * | 2/2006 | Yamashita | G09G 3/2014 257/565 |
| 2006/0077077 | A1 * | 4/2006 | Kwon | G09G 3/3241 341/50 |
| 2006/0221005 | A1 * | 10/2006 | Omata | G09G 3/3241 345/76 |
| 2007/0024543 | A1 * | 2/2007 | Chung | G09G 3/3233 345/76 |

* cited by examiner

*Primary Examiner* — Van N Chow
(74) *Attorney, Agent, or Firm* — Innovation Counsel, LLP

(57) ABSTRACT

A pixel circuit includes an OLED, an OLED driving block, a first switch, and a second switch. The OLED has an anode and a cathode connected to ELVSS. The OLED driving block connected between the anode and ELVDD controls a driving current flowing through the OLED, a first switch is turned on or off responding to a first control-signal and transfers a sensing-bias-voltage to the anode when turned on. The second switch is turned on or off responding to a second control-signal and transfers a deterioration-sensing-voltage to the anode when turned on. In a display mode, the first and second switches are turned off. In a deterioration sensing mode, the first switch is turned on and the second switch is turned off during a first time, and the first switch is turned off and the second switch is turned on during a second time.

20 Claims, 10 Drawing Sheets

PIXEL CIRCUIT AND ORGANIC LIGHT EMITTING DISPLAY DEVICE INCLUDING THE SAME

CROSS-REFERENCE TO RELATED APPLICATION(S)

This application claims priority under 35 USC § 119 to Korean Patent Applications No. 10-2015-0189236, filed on Dec. 30, 2015 in the Korean Intellectual Property Office (KIPO), the contents of which are incorporated herein in its entirety by reference.

BACKGROUND

1. Technical Field

Example embodiments of the present inventive concept relate generally to an organic light emitting display device. More particularly, embodiments of the present inventive concept relate to a pixel circuit capable of sensing deterioration (or degradation) of an organic light emitting diode and an organic light emitting display device including the pixel circuit.

2. Description of the Related Art

Recently, organic light emitting display devices which include pixel circuits each including an organic light emitting diode are widely used as display devices. Generally, in an organic light emitting display device, the organic light emitting diode is deteriorated as the organic light emitting diode is used. Thus, the deterioration of the organic light emitting diode must be compensated for so that the luminance of the deteriorated organic light emitting diode remains the same as the luminance of a non-deteriorated organic light emitting diode. To accomplish this, a conventional organic light emitting display device senses the deterioration of the organic light emitting diode by sensing a current flowing through the organic light emitting diode by applying a deterioration sensing voltage to the organic light emitting diode in a deterioration sensing mode and by generating deterioration sensing data based on the sensed current. However, since characteristics of the organic light emitting diode are changed according to a temperature and/or a surrounding environment, the current flowing through the organic light emitting diode may be changed according to the temperature and/or the surrounding environment. Particularly, whenever the deterioration of the organic light emitting diode is sensed, different deterioration sensing data may be generated because the temperature of the organic light emitting diode may be changed (e.g., increased) as the number of sensing the deterioration of the organic light emitting diode increases. As a result, the conventional organic light emitting display device may not accurately compensate for the deterioration of the organic light emitting diode included in each pixel circuit.

SUMMARY

Some example embodiments provide a pixel circuit that can accurately sense deterioration of an organic light emitting diode therein regardless of a temperature and/or a surrounding environment.

Some example embodiments provide an organic light emitting display device that can accurately compensate for deterioration of an organic light emitting diode regardless of a temperature and/or a surrounding environment by including the pixel circuit.

According to an aspect of example embodiments, a pixel circuit may include an organic light emitting diode having an anode and a cathode, the cathode being connected to a low power voltage, an organic light emitting diode driving block connected between the anode of the organic light emitting diode and a high power voltage and configured to control a driving current flowing through the organic light emitting diode based on a data signal applied via a data-line, a first switch configured to be turned on or off in response to a first control signal and to transfer a sensing bias voltage to the anode of the organic light emitting diode when being turned on, and a second switch configured to be turned on or off in response to a second control signal and to transfer a deterioration sensing voltage to the anode of the organic light emitting diode when being turned on. In addition, in a display mode, the first and second switches may be turned off. Further, in a deterioration sensing mode, the first switch may be turned on and the second switch may be turned off during a first time, and the first switch may be turned off and the second switch may be turned on during a second time following the first time.

In example embodiments, the second switch may be connected between the data-line and the anode of the organic light emitting diode. In addition, the deterioration sensing voltage may be applied via the data-line during the second time of the deterioration sensing mode.

In example embodiments, the first and second switches may be implemented by p-channel metal oxide semiconductor (PMOS) transistors. In addition, the first switch may be turned on when the first control signal has a low voltage level, and the second switch may be turned on when the second control signal has the low voltage level. Further, the first switch may be turned off when the first control signal has a high voltage level, and the second switch may be turned off when the second control signal has the high voltage level.

In example embodiments, the first and second switches may be implemented by n-channel metal oxide semiconductor (NMOS) transistors. In addition, the first switch may be turned on when the first control signal has a high voltage level, and the second switch may be turned on when the second control signal has the high voltage level. Further, the first switch may be turned off when the first control signal has a low voltage level, and the second switch may be turned off when the second control signal has the low voltage level.

In example embodiments, a sensing bias current that is generated based on the sensing bias voltage applied to the anode of the organic light emitting diode and the low power voltage applied to the cathode of the organic light emitting diode may flow through the organic light emitting diode during the first time of the deterioration sensing mode.

In example embodiments, the first time of the deterioration sensing mode may be set to be longer than or equal to a time during which a temperature of the organic light emitting diode reaches a predetermined sensing reference temperature as the sensing bias current flows through the organic light emitting diode.

In example embodiments, a deterioration sensing current that is generated based on the deterioration sensing voltage applied to the anode of the organic light emitting diode and the low power voltage applied to the cathode of the organic light emitting diode may flow through the organic light emitting diode during the second time of the deterioration sensing mode.

In example embodiments, the second time of the deterioration sensing mode may be a time generated by subtracting the first time of the deterioration sensing mode from a predetermined sensing allowable time for sensing deterioration of the organic light emitting diode.

According to an aspect of example embodiments, an organic light emitting display device may include a display panel including a plurality of pixel circuits each including an organic light emitting diode, a scan driving part configured to provide a scan signal to the display panel, a data driving part configured to provide a data signal to the display panel, a deterioration compensating part configured to control a sensing bias current to flow through the organic light emitting diode during a first time, to control a deterioration sensing current to flow through the organic light emitting diode during a second time following the first time, to determine deterioration of the organic light emitting diode by comparing the deterioration sensing current with a predetermined sensing reference current, and to generate deterioration compensation information for compensating for the deterioration of the organic light emitting diode in a deterioration sensing mode, and a timing control part configured to control the scan driving part, the data driving part, and the deterioration compensating part and to compensate image data corresponding to the data signal based on the deterioration compensation information.

In example embodiments, the deterioration compensating part may be implemented inside the timing control part or the data driving part.

In example embodiments, the deterioration sensing mode may be executed at a time point when the display panel is powered on or off.

In example embodiments, in the deterioration sensing mode, the deterioration compensating part may generate the deterioration compensation information for all of the plurality of pixel circuits or may generate the deterioration compensation information for some of the pixel circuits.

In example embodiments, each of the plurality of pixel circuits may include the organic light emitting diode having an anode and a cathode that is connected to a low power voltage, an organic light emitting diode driving block connected between the anode of the organic light emitting diode and a high power voltage and configured to control a driving current flowing through the organic light emitting diode based on the data signal applied via a data-line, a first switch configured to be turned on or off in response to a first control signal and to transfer a sensing bias voltage to the anode of the organic light emitting diode when being turned on, and a second switch configured to be turned on or off in response to a second control signal and to transfer a deterioration sensing voltage to the anode of the organic light emitting diode when being turned on. In addition, in a display mode, the first and second switches may be turned off. Further, in the deterioration sensing mode, the first switch may be turned on and the second switch may be turned off during the first time, and the first switch may be turned off and the second switch may be turned on during the second time.

In example embodiments, the second switch may be connected between the data-line and the anode of the organic light emitting diode. In addition, the deterioration sensing voltage may be applied via the data-line during the second time of the deterioration sensing mode.

In example embodiments, the first and second switches may be implemented by p-channel metal oxide semiconductor (PMOS) transistors. In addition, the first switch may be turned on when the first control signal has a low voltage level, and the second switch may be turned on when the second control signal has the low voltage level. Further, the first switch may be turned off when the first control signal has a high voltage level, and the second switch may be turned off when the second control signal has the high voltage level.

In example embodiments, the first and second switches may be implemented by n-channel metal oxide semiconductor (NMOS) transistors. In addition, the first switch may be turned on when the first control signal has a high voltage level, and the second switch may be turned on when the second control signal has the high voltage level. Further, the first switch may be turned off when the first control signal has a low voltage level, and the second switch may be turned off when the second control signal has the low voltage level.

In example embodiments, the sensing bias current that is generated based on the sensing bias voltage applied to the anode of the organic light emitting diode and the low power voltage applied to the cathode of the organic light emitting diode may flow through the organic light emitting diode during the first time of the deterioration sensing mode.

In example embodiments, the first time of the deterioration sensing mode may be set to be longer than or equal to a time during which a temperature of the organic light emitting diode reaches a predetermined sensing reference temperature as the sensing bias current flows through the organic light emitting diode.

In example embodiments, the deterioration sensing current that is generated based on the deterioration sensing voltage applied to the anode of the organic light emitting diode and the low power voltage applied to the cathode of the organic light emitting diode may flow through the organic light emitting diode during the second time of the deterioration sensing mode.

In example embodiments, the second time of the deterioration sensing mode may be a time generated by subtracting the first time of the deterioration sensing mode from a predetermined sensing allowable time for sensing the deterioration of the organic light emitting diode.

Therefore, a pixel circuit according to example embodiments may accurately sense deterioration of an organic light emitting diode therein regardless of a temperature and/or a surrounding environment by raising a temperature of the organic light emitting diode by applying a sensing bias voltage to the organic light emitting diode before applying a deterioration sensing voltage to the organic light emitting diode in a deterioration sensing mode.

In addition, an organic light emitting display device including the pixel circuit according to example embodiments may provide a high-quality image to a viewer (i.e., user) by accurately compensating for deterioration of an organic light emitting diode regardless of a temperature and/or a surrounding environment.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Hereinafter, the present invention will be explained in detail with reference to the accompanying drawings.

Figure 1:
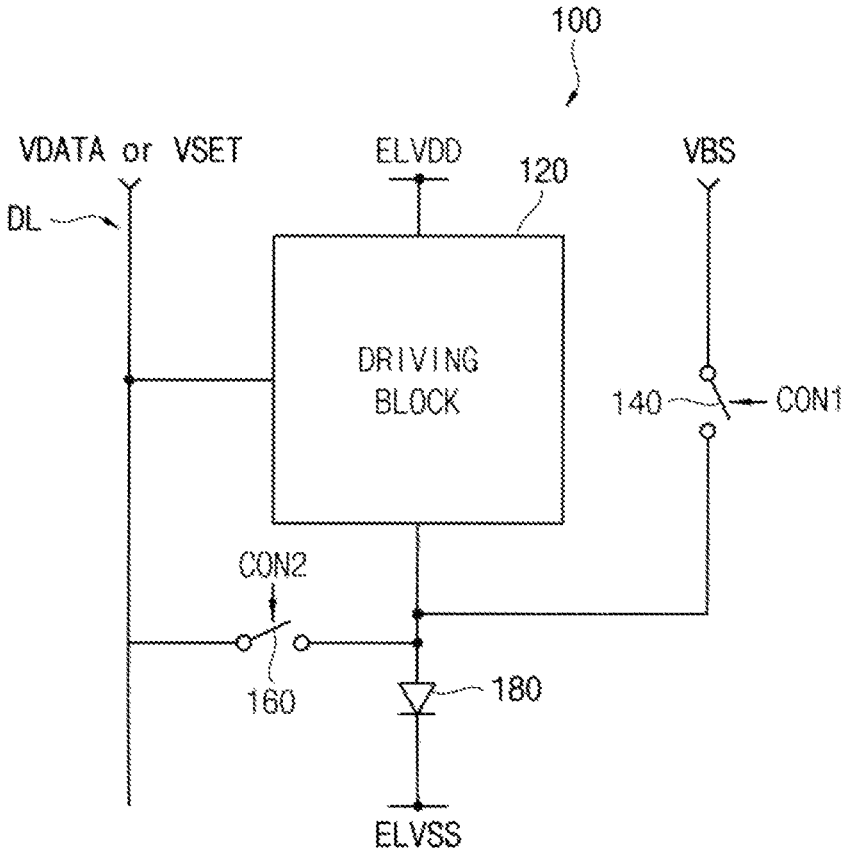
FIG. 1 is a diagram illustrating a pixel circuit according to example embodiments.
Figure 2:
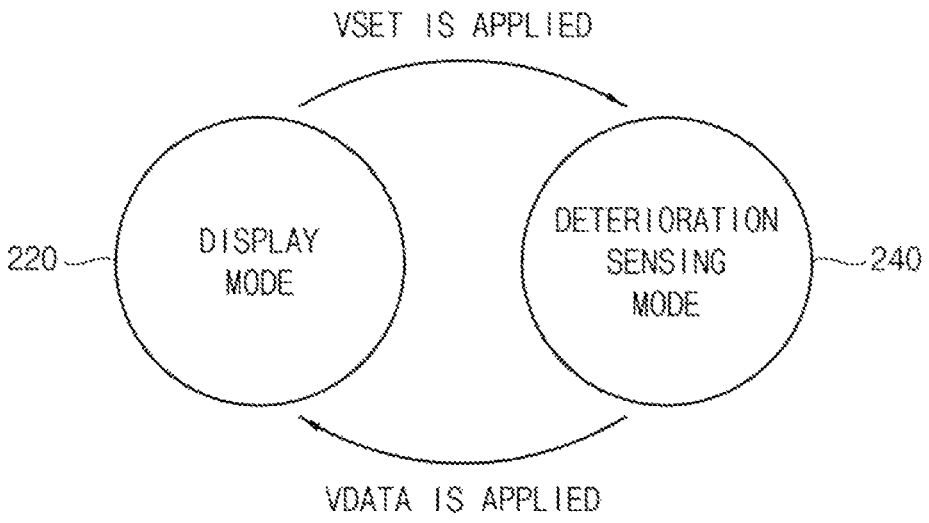
FIG. 2 is a diagram illustrating an operating mode of the pixel circuit of FIG. 1.

FIG. 1 is a diagram illustrating a pixel circuit according to example embodiments. FIG. 2 is a diagram illustrating an operating mode of the pixel circuit of FIG. 1.

Referring to FIGS. 1 and 2, the pixel circuit 100 may include an organic light emitting diode driving block 120, a first switch 140, a second switch 160, and an organic light emitting diode 180. Although it is illustrated in FIG. 1 that a deterioration sensing voltage VSET is applied to the second switch 160 via a data-line DL because the second switch 160 is connected to the data-line DL, in other example embodiments, the deterioration sensing voltage VSET may be applied to the second switch 160 via another line other than the data-line DL.

The organic light emitting diode driving block 120 may control a driving current flowing through the organic light emitting diode 180 based on a data voltage applied via the data-line DL (i.e., a data signal VDATA). For this operation, the organic light emitting diode driving block 120 may include at least one capacitor (e.g., a storage capacitor, etc) and transistors (e.g., a switching transistor, a driving transistor, etc). The organic light emitting diode driving block 120 may be connected between an anode of the organic light emitting diode 180 and a high power voltage ELVDD. In example embodiments, the organic light emitting diode driving block 120 may receive the data signal VDATA via the data-line DL and may receive a scan signal via a scan-line. In some example embodiments, the organic light emitting diode driving block 120 may receive an emission control signal via an emission control-line.

The first switch 140 may be connected between a sensing bias voltage VBS and the anode of the organic light emitting diode 180. The first switch 140 may be turned on or off based on a first control signal CON1. Thus, the first switch 140 may transfer the sensing bias voltage VBS to the anode of the organic light emitting diode 180 when being turned on. For example, the first switch 140 may be connected to a voltage source which generates the sensing bias voltage VBS, and the sensing bias voltage VBS supplied from the voltage source in a deterioration sensing mode 240 of the pixel circuit 100 may be transferred to the anode of the organic light emitting diode 180 while the first switch 140 is turned on. In an example embodiment, the first switch 140 may be implemented by a p-channel metal oxide semiconductor (PMOS) transistor. In this case, the first switch 140 may be turned on when the first control signal CON1 has a low voltage level and may be turned off when the first control signal CON1 has a high voltage level. In another example embodiment, the first switch 140 may be implemented by an n-channel metal oxide semiconductor (NMOS) transistor. In this case, the first switch 140 may be turned on when the first control signal CON1 has a high voltage level and may be turned off when the first control signal CON1 has a low voltage level.

The second switch 160 may be connected between a deterioration sensing voltage VSET and the anode of the organic light emitting diode 180. The second switch 160 may be turned on or off based on a second control signal CON2. Thus, the second switch 160 may transfer the deterioration sensing voltage VSET to the anode of the organic light emitting diode 180 when the second switch 160 is turned on. In an example embodiment, the second switch 160 may be implemented by a PMOS transistor. In this case, the second switch 160 may be turned on when the second control signal CON2 has a low voltage level and may be turned off when the second control signal CON2 has a high voltage level. In another example embodiment, the second switch 160 may be implemented by an NMOS transistor. In this case, the second switch 160 may be turned on when the second control signal CON2 has a high voltage level and may be turned off when the second control signal CON2 has a low voltage level. As illustrated in FIG. 1, the second switch 160 may be connected between the data-line DL and the anode of the organic light emitting diode 180. In this case, the deterioration sensing voltage VSET applied via the data-line DL in the deterioration sensing mode 240 of the pixel circuit 100 may be transferred to the anode of the organic light emitting diode 180 while the second switch 160 is turned on.

The organic light emitting diode 180 may include the anode that is connected to the organic light emitting diode driving block 120 and a cathode that is connected to a low power voltage ELVSS. The organic light emitting diode 180 may emit light based on the driving current flowing through the organic light emitting diode 180, where the driving current is controlled by the organic light emitting diode driving block 120. Generally, the organic light emitting diode 180 is deteriorated as the organic light emitting diode 180 is used. Thus, it is required to compensate for the deterioration of the organic light emitting diode 180 to make the luminance of the deteriorated organic light emitting diode 180 be the same as luminance of a non-deteriorated organic light emitting diode. To accomplish this, a conventional organic light emitting display device senses the deterioration of the organic light emitting diode 180 by sensing a current flowing through the organic light emitting diode 180 by applying the deterioration sensing voltage VSET to the organic light emitting diode 180 and by generating deterioration sensing data based on the sensed current. However, since characteristics of the organic light emitting diode 180 are changed according to a temperature and/or a surrounding environment, the current flowing through the organic light emitting diode 180 may be changed according to the temperature and/or the surrounding environment.

Thus, whenever the deterioration of the organic light emitting diode 180 is sensed, the conventional organic light emitting display device may generate different deterioration sensing data according to the temperature and/or the surrounding environment. Thus, the conventional approach is flawed.

In contrast to the conventional approach and to overcome this problem, example embodiments of the present inventive concept may have the pixel circuit 100 divide the deterioration sensing mode 240 into a first time and a second time following the first time. Here, the pixel circuit 100 may make a temperature of the organic light emitting diode 180 reach a predetermined sensing reference temperature by applying the sensing bias voltage VBS to the organic light emitting diode 180 during the first time of the deterioration sensing mode 240 and then may generate deterioration sensing data by applying the deterioration sensing voltage VSET to the organic light emitting diode 180 during the second time of the deterioration sensing mode 240. In other words, the pixel circuit 100 may create the same condition for sensing the deterioration of the organic light emitting diode 180 by making the temperature of the organic light emitting diode 180 reach the predetermined sensing reference temperature by applying the sensing bias voltage VBS to the organic light emitting diode 180 during the first time of the deterioration sensing mode 240. As a result, the pixel circuit 100 may accurately sense the deterioration of the organic light emitting diode 180 regardless of the temperature and/or the surrounding environment, and thus an organic light emitting display device including the pixel circuit 100 may accurately compensate for the deterioration of the organic light emitting diode 180. These operations may be performed by turn-on and turn-off operations of the first and second switches 140 and 160 included in the pixel circuit 100.

Specifically, as illustrated in FIG. 2, the pixel circuit 100 may operate in the display mode 220 or in the deterioration sensing mode 240. In the display mode 220 of the pixel circuit 100, the pixel circuit 100 may receive the data signal VDATA for performing a display operation via the data-line DL. In the deterioration sensing mode 240 of the pixel circuit 110, the pixel circuit 100 may receive the deterioration sensing voltage VSET for performing a deterioration sensing operation via the data-line DL. In some example embodiments, the pixel circuit 100 may receive the deterioration sensing voltage VSET for performing the deterioration sensing operation via a specific line other than the data-line DL. Hereinafter, the operations (i.e., turn-on and turn-off operations) of the first and second switches 140 and 160 in the display mode 220 of the pixel circuit 100 and the operations (i.e., turn-on and turn-off operations) of the first and second switches 140 and 160 in the deterioration sensing mode 240 of the pixel circuit 100 will be described in detail.

In the display mode 220 of the pixel circuit 100, the first switch 140 may be turned off, and the second switch 160 may be turned off. That is, in the display mode 220 of the pixel circuit 100, the sensing bias voltage VBS and the deterioration sensing voltage VSET may not be applied to the anode of the organic light emitting diode 180. During the first time of the deterioration sensing mode 240 of the pixel circuit 100, the first switch 140 may be turned on, and the second switch 160 may be turned off. That is, during the first time of the deterioration sensing mode 240 of the pixel circuit 100, the sensing bias voltage VBS may be applied to the anode of the organic light emitting diode 180 because only the first switch 140 is turned on. Thus, during the first time of the deterioration sensing mode 240 of the pixel circuit 100, the sensing bias current that is generated based on the sensing bias voltage VBS and the low power voltage ELVSS may flow through the organic light emitting diode 180, and thus the temperature of the organic light emitting diode 180 may reach the predetermined sensing reference temperature. In an example embodiment, the first time of the deterioration sensing mode 240 of the pixel circuit 100 may be set to be longer than or equal to a time during which the temperature of the organic light emitting diode 180 reaches the predetermined sensing reference temperature as the sensing bias current flows through the organic light emitting diode 180. Subsequently, during the second time of the deterioration sensing mode 240 of the pixel circuit 100, the first switch 140 may be turned off, and the second switch 160 may be turned on. That is, during the second time of the deterioration sensing mode 240 of the pixel circuit 100, the deterioration sensing voltage VSET may be applied to the anode of the organic light emitting diode 180 because only the second switch 160 is turned on. Thus, during the second time of the deterioration sensing mode 240 of the pixel circuit 100, the deterioration sensing current that is generated based on the deterioration sensing voltage VSET and the low power voltage ELVSS may flow through the organic light emitting diode 180, and thus the deterioration sensing data corresponding to the deterioration sensing current may be generated (e.g., the deterioration sensing data may be generated by performing an analog-to-digital conversion on the deterioration sensing current). In an example embodiment, the second time of the deterioration sensing mode 240 of the pixel circuit 100 may be a time generated by subtracting the first time of the deterioration sensing mode 240 of the pixel circuit 100 from a predetermined sensing allowable time for sensing the deterioration of the organic light emitting diode 180.

As described above, the pixel circuit 100 may accurately sense the deterioration of the organic light emitting diode 180 regardless of the temperature and/or the surrounding environment (i.e., may improve a signal-to-noise ration (SNR) of the deterioration sensing data) by raising the temperature of the organic light emitting diode 180 by applying the sensing bias voltage VBS to the organic light emitting diode 180 before applying the deterioration sensing voltage VSET to the organic light emitting diode 180 in the deterioration sensing mode 240. Thus, an organic light emitting display device including the pixel circuit 100 may provide a high-quality image to a viewer (i.e., user) by accurately compensating for the deterioration of the organic light emitting diode 180 regardless of the surrounding temperature and/or the surrounding environment. Although it is described with reference to FIG. 1 that the sensing bias voltage VBS applied during the first time of the deterioration sensing mode 240 of the pixel circuit 100 is a positive voltage, in some example embodiments, the sensing bias voltage VBS applied during the first time of the deterioration sensing mode 240 of the pixel circuit 100 may be a negative voltage. In this case, the pixel circuit 100 may stabilize (or, initialize) characteristics of the organic light emitting diode 180 before the deterioration sensing current flows through the organic light emitting diode 180 in the deterioration sensing mode 240.

Figure 3:
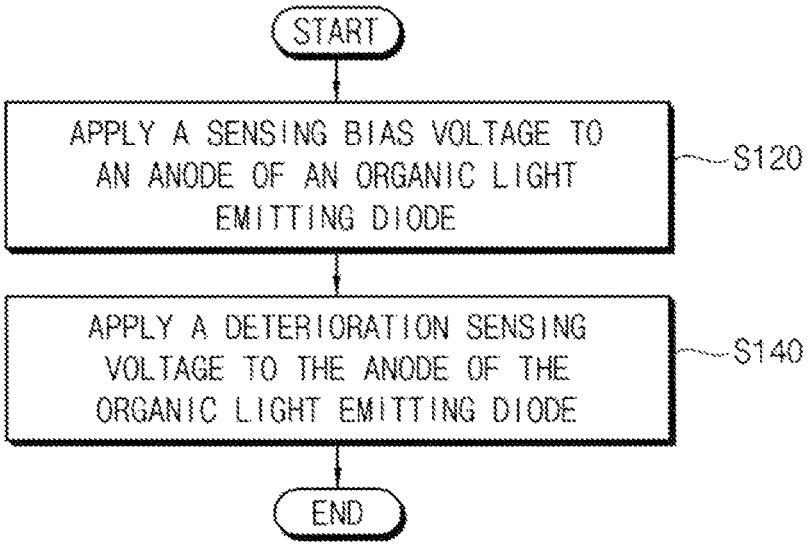
FIG. 3 is a flowchart illustrating a process in which deterioration of an organic light emitting diode is sensed in the pixel circuit of FIG. 1.
Figure 4:
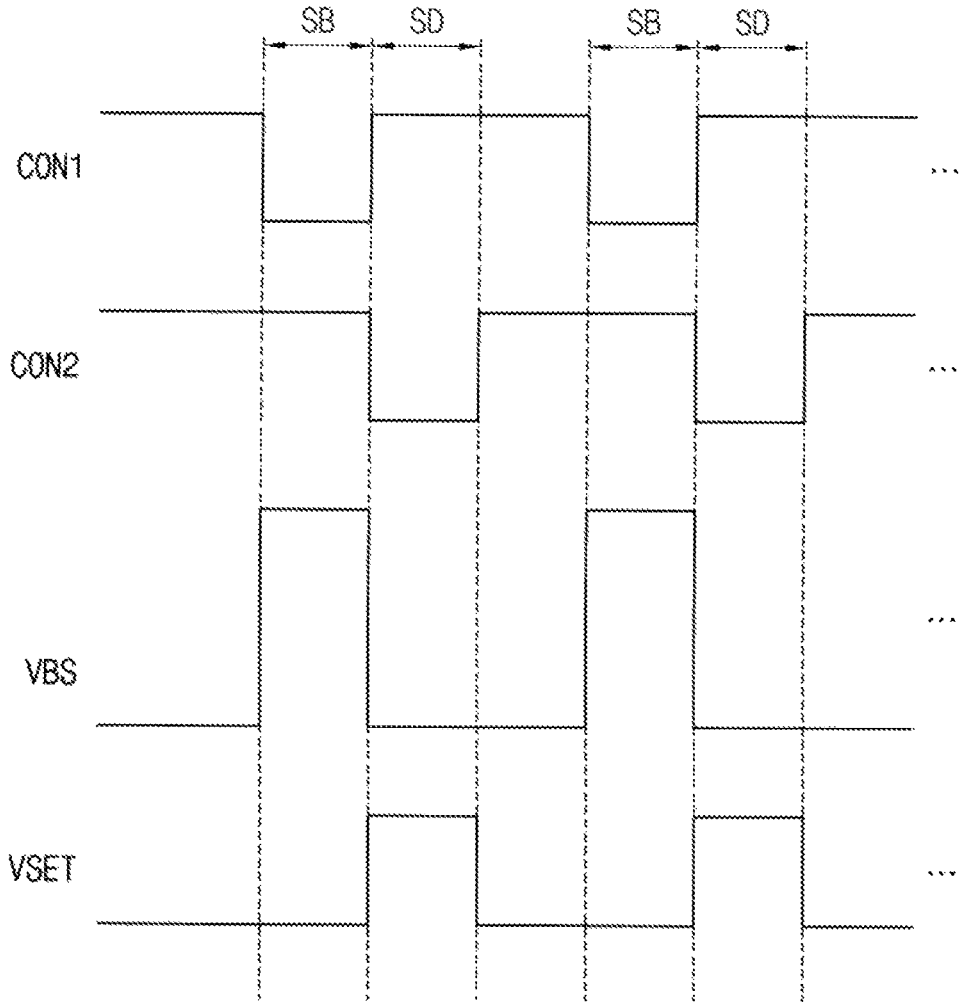
FIG. 4 is a timing diagram illustrating a process in which deterioration of an organic light emitting diode is sensed in the pixel circuit of FIG. 1.
Figure 5A:
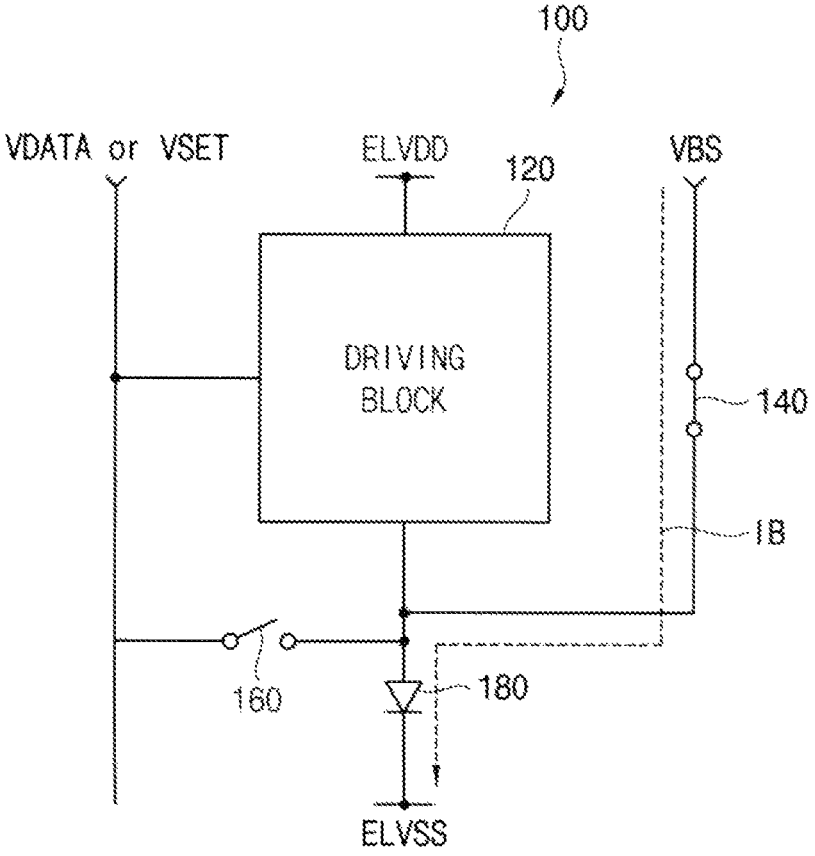
FIGS. 5A and 5B are diagrams illustrating a process in which deterioration of an organic light emitting diode is sensed in the pixel circuit of FIG. 1.
Figure 5B:
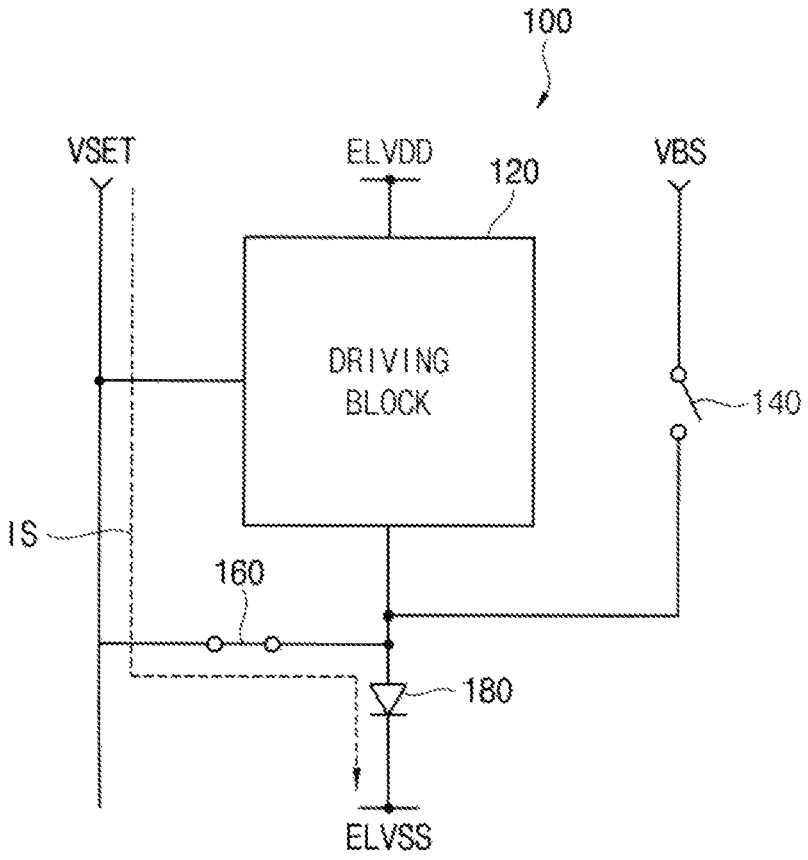

FIG. 3 is a flowchart illustrating a process in which deterioration of an organic light emitting diode is sensed in the pixel circuit of FIG. 1. FIG. 4 is a timing diagram illustrating a process in which deterioration of an organic light emitting diode is sensed in the pixel circuit of FIG. 1. FIGS. 5A and 5B are diagrams illustrating a process in which deterioration of an organic light emitting diode is sensed in the pixel circuit of FIG. 1.

Referring to FIGS. 3 through 5B, an operation of the pixel circuit 100 for sensing the deterioration of the organic light emitting diode 180 in the deterioration sensing mode 240 of the pixel circuit 100 is illustrated. Specifically, the pixel circuit 100 may apply the sensing bias voltage VBS to the anode of the organic light emitting diode 180 during the first time SB of the deterioration sensing mode 240 of the pixel circuit 100 (S120) and then may apply the deterioration sensing voltage VSET to the anode of the organic light emitting diode 180 during the second time SD of the deterioration sensing mode 240 of the pixel circuit 100 (S140). On this basis, the pixel circuit 100 may accurately sense the deterioration of the organic light emitting diode 180 regardless of the temperature and/or the surrounding environment by raising the temperature of the organic light emitting diode 180 before sensing the deterioration of the organic light emitting diode 180. In FIG. 4, for convenience of description only, it is assumed that the first and second switches 140 and 160 included in the pixel circuit 100 are PMOS transistors.

As illustrated in FIGS. 4 and 5A, during the first time SB of the deterioration sensing mode 240 of the pixel circuit 100, the first control signal CON1 may have a low voltage level, and the second control signal CON2 may have a high voltage level. Thus, during the first time SB of the deterioration sensing mode 240 of the pixel circuit 100, the first switch 140 may be turned on, and the second switch 160 may be turned on, since in these example embodiments the first and second switches 140 and 160 are assumed to be PMOS transistors. Accordingly, during the first time SB of the deterioration sensing mode 240 of the pixel circuit 100, the sensing bias voltage VBS having a high voltage level may be applied to the anode of the organic light emitting diode 180 because only the first switch 140 is turned on, and thus the sensing bias current IB that is generated based on the sensing bias voltage VBS and the low power voltage ELVSS may flow through the organic light emitting diode 180. As a result, the temperature of the organic light emitting diode 180 may reach the predetermined sensing reference temperature. Subsequently, as illustrated in FIGS. 4 and 5B, during the second time SD of the deterioration sensing mode 240 of the pixel circuit 100, the first control signal CON1 may have a high voltage level, and the second control signal CON2 may have a low voltage level. Thus, during the second time SD of the deterioration sensing mode 240 of the pixel circuit 100, the first switch 140 may be turned off, and the second switch 160 may be turned on. Accordingly, during the second time SD of the deterioration sensing mode 240 of the pixel circuit 100, the deterioration sensing voltage VSET may be applied to the anode of the organic light emitting diode 180 because only the second switch 160 is turned on, and thus the deterioration sensing current IS that is generated based on the deterioration sensing voltage VSET and the low power voltage ELVSS may flow through the organic light emitting diode 180. As a result, the deterioration sensing current IS flowing through the organic light emitting diode 180 may be sensed, and then the deterioration sensing data corresponding to the deterioration sensing current IS may be generated. In an example embodiment, as illustrated in FIG. 4, an operation of applying the sensing bias voltage VBS and the deterioration sensing voltage VSET to the anode of the organic light emitting diode 180 may be repeated several times in the deterioration sensing mode 240 of the pixel circuit 100 to increase an accuracy of sensing the deterioration of the organic light emitting diode 180. In another example embodiment, the operation of applying the sensing bias voltage VBS and the deterioration sensing voltage VSET to the anode of the organic light emitting diode 180 may be performed only once in the deterioration sensing mode 240 of the pixel circuit 100. Although it is illustrated in FIG. 4 that the first time SB is set to be equal to the second time SD, in some example embodiments, the first time SB may be set to be different from the second time SD.

Figure 6:
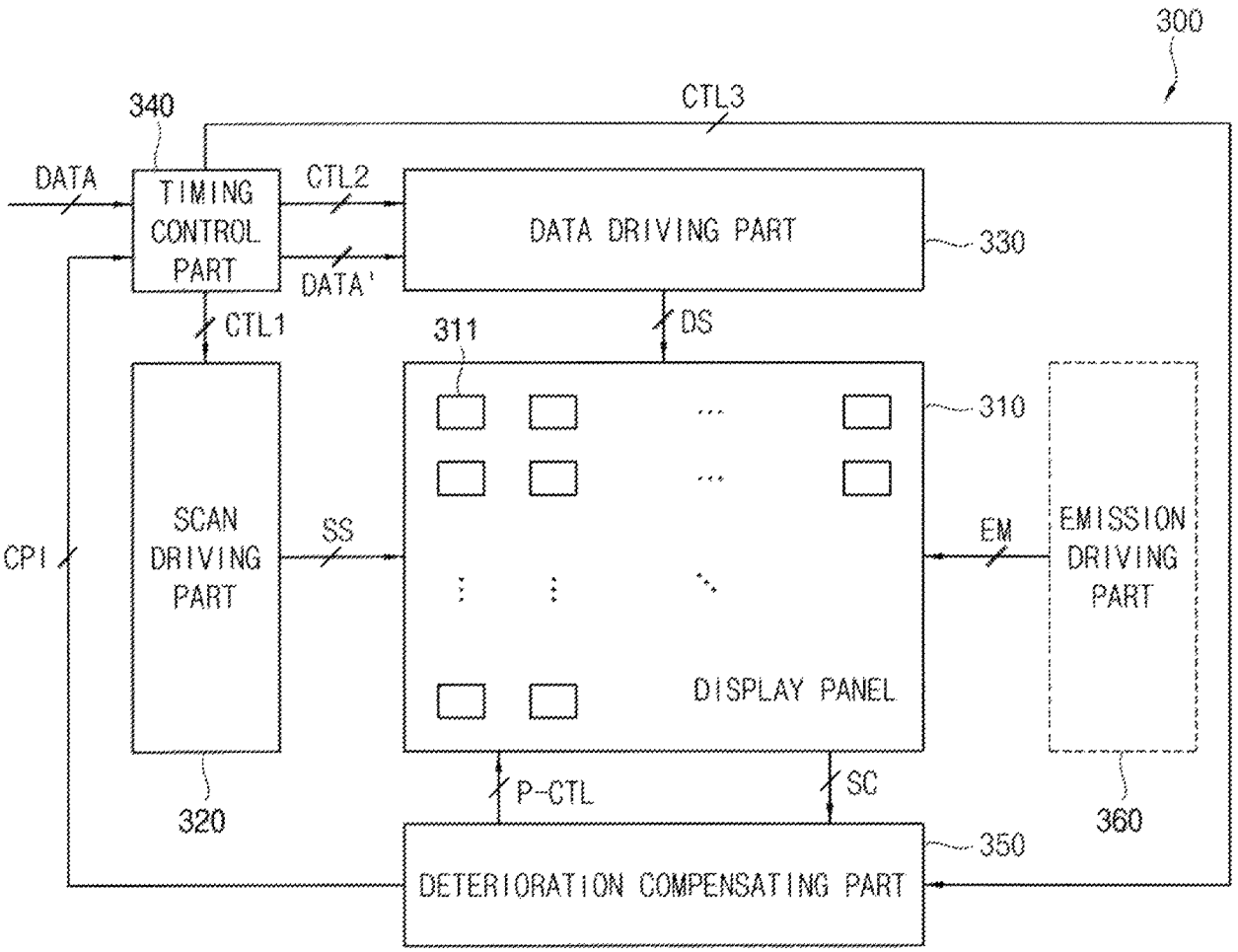
FIG. 6 is a block diagram illustrating an organic light emitting display device according to example embodiments.
Figure 7:
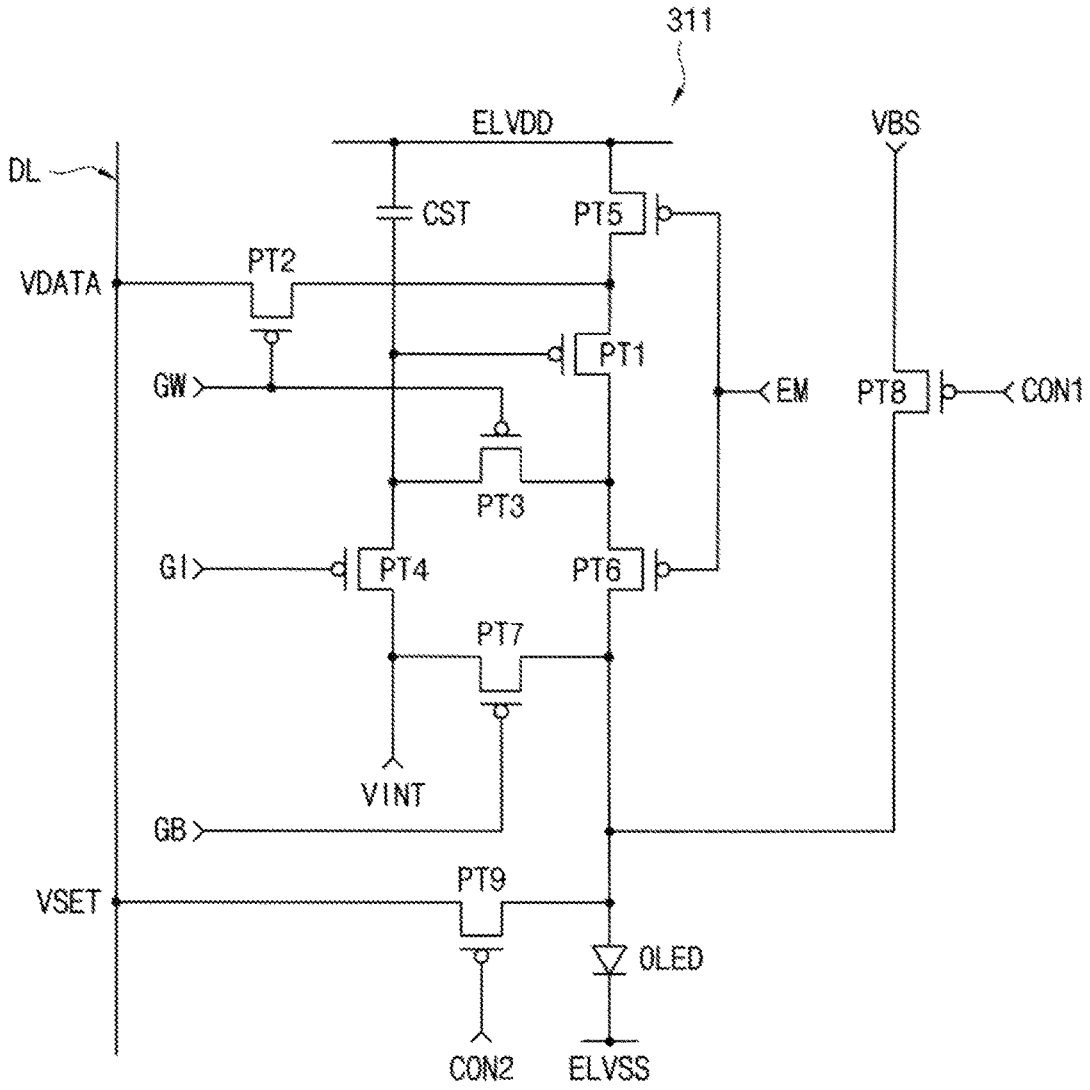
FIG. 7 is a circuit diagram illustrating an example of a pixel circuit of a display panel included in the organic light emitting display device of FIG. 6.
Figure 8:
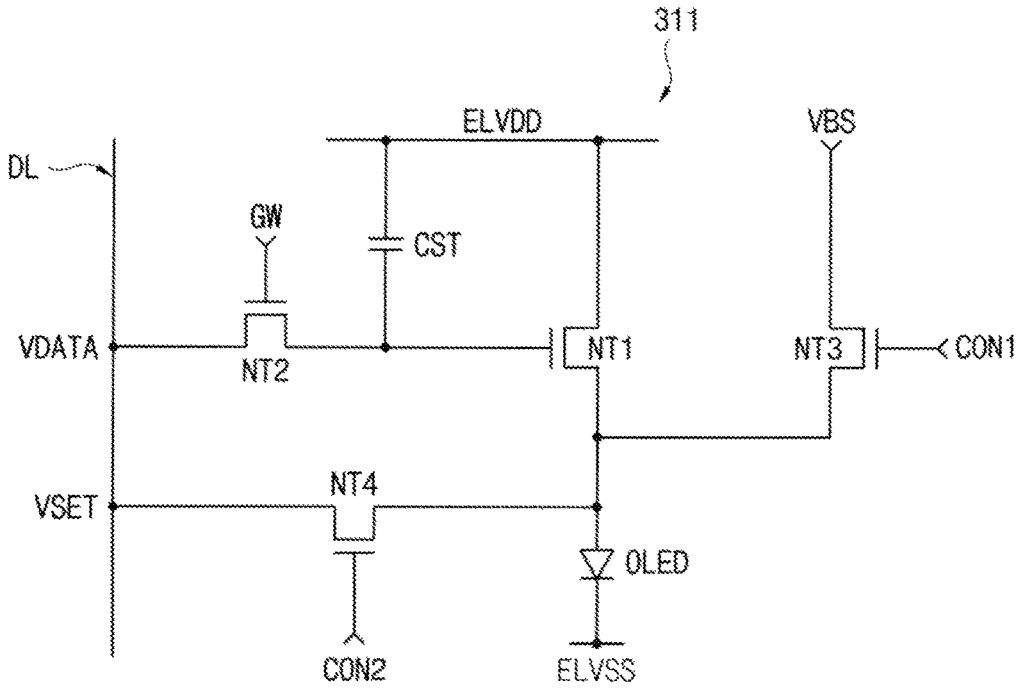
FIG. 8 is a circuit diagram illustrating another example of a pixel circuit of a display panel included in the organic light emitting display device of FIG. 6.

FIG. 6 is a block diagram illustrating an organic light emitting display device according to example embodiments. FIG. 7 is a circuit diagram illustrating an example of a pixel circuit of a display panel included in the organic light emitting display device of FIG. 6. FIG. 8 is a circuit diagram illustrating another example of a pixel circuit of a display panel included in the organic light emitting display device of FIG. 6.

Referring to FIGS. 6 through 8, the organic light emitting display device 300 may include a display panel 310, a scan driving part 320, a data driving part 330, a timing control part 340, and a deterioration compensating part 350. In some example embodiments, when a pixel circuit 311 included in the display panel 310 requires an emission control signal EM, the organic light emitting display device 300 may further include an emission driving part 360.

The display panel 310 may include a plurality of pixel circuits 311. Each of the pixel circuits 311 may include an organic light emitting diode OLED. The display panel 310 may be connected to the scan driving part 320 via scan-lines and may be connected to the data driving part 330 via data-lines DL. In some example embodiments, the display panel 310 may be connected to the emission driving part 360 via emission control-lines. The scan driving part 320 may provide a scan signal SS to the display panel 310 via the scan-lines. The data driving part 330 may provide a data signal DS to the display panel 310 via the data-lines DL. The emission driving part 360 may provide the emission control signal EM to the display panel 310 via the emission control-lines. In a deterioration sensing mode, the deterioration compensating part 350 may control a sensing bias current to flow through the organic light emitting diode OLED during a first time, may control a deterioration sensing current SC to flow though the organic light emitting diode OLED during a second time following the first time, may determine the deterioration of the organic light emitting diode OLED by comparing the deterioration sensing current SC with a predetermined sensing reference current, and may generate deterioration compensation information CPI for compensating for the deterioration of the organic light emitting diode OLED. To this end, the deterioration compensating part 350 may provide a deterioration sensing control signal P-CTL to the display panel 310 and may receive the deterioration sensing current SC from the display panel 310 (i.e., each pixel circuit 311 included in the display panel 310). In some example embodiments, the deterioration compensating part 350 may generate the deterioration sensing data by performing an analog-to-digital conversion on the deterioration sensing current SC and may determine the deterioration of the organic light emitting diode OLED by comparing the deterioration sensing data with predetermined sensing reference data. In an example embodiment, the deterioration compensating part 350 may generate the deterioration compensation information CPI for all of the pixel circuits 311 included in the display panel 310 in the deterioration sensing mode. In another example embodiment, the deterioration compensating part 350 may generate the deterioration compensation information CPI for some of the pixel circuits 311 included in the display panel 310 in the deterioration sensing mode. In this case, the deterioration compensating part 350 may determine (or, select) target pixel circuits 311 on which a deterioration sensing operation is to be performed among the pixel circuits 311 included in the display panel 310 by prioritizing the pixel circuits 311 included in the display panel 310 based on a specific criterion (e.g., a degree of deterioration, etc).

The timing control part 340 may generate driving control signals CTL1, CTL2, and CTL3 to control the scan driving part 320, the data driving part 330, and the deterioration compensating part 350. In some example embodiments, when the organic light emitting display device 300 includes the emission driving part 360, the timing control part 340 may generate a driving control signal (not illustrated) to be provided to the emission driving part 360. Thus, the emission driving part 360 may be controlled by the driving control signal provided from the timing control part 340. In example embodiments, the timing control part 340 may receive image data DATA, may generate final image data DATA' by performing a specific data processing (e.g., deterioration compensation, etc) on the image data DATA, and may provide the final image data DATA' to the data driving part 330. In other words, the timing control part 340 may compensate the image data DATA corresponding to the data signal DS based on the deterioration compensation information CPI provided from the deterioration compensating part 350. In an example embodiment, as illustrated in FIG. 6, the deterioration compensating part 350 may be located (i.e., implemented) outside the timing control part 340 and the data driving part 330. In another example embodiment, the deterioration compensating part 350 may be located (i.e., implemented) inside the timing control part 340 or the data driving part 330. In an example embodiment, the organic light emitting display device 300 may enter the deterioration sensing mode at a time point when the display panel 310 is powered on. In another example embodiment, the organic light emitting display device 300 may enter the deterioration sensing mode at a time point when the display panel 310 is powered off. In still another example embodiment, the organic light emitting display device 300 may enter the deterioration sensing mode at both a time point when the display panel 310 is powered on and a time point when the display panel 310 is powered off. However, a time point at which the organic light emitting display device 300 enters the deterioration sensing mode is not limited thereto.

As described above, the organic light emitting display device 300 may accurately sense the deterioration of the organic light emitting diode OLED included in the pixel circuit 311 regardless of the temperature and/or the surrounding environment by raising the temperature of the organic light emitting diode OLED included in the pixel circuit 311 by applying the sensing bias voltage VBS to the organic light emitting diode OLED included in the pixel circuit 311 before applying the deterioration sensing voltage VSET to the organic light emitting diode OLED included in the pixel circuit 311 in the deterioration sensing mode. Thus, the organic light emitting display device 300 may provide a high-quality image to a viewer by accurately compensating for the deterioration of the organic light emitting diode OLED included in the pixel circuit 311 independent of the temperature and/or the surrounding environment. For this operation, each of the pixel circuits 311 included in the display panel 310 may include the organic light emitting diode OLED, an organic light emitting diode driving block, a first switch, and a second switch. The organic light emitting diode OLED may include the anode that is connected to the organic light emitting diode driving block and a cathode that is connected to the low power voltage ELVSS. The organic light emitting diode driving block may be connected between the anode of the organic light emitting diode OLED and a high power voltage ELVDD. The organic light emitting diode driving block may control a driving current flowing through the organic light emitting diode OLED based on the data signal DS applied via the data-line DL. The first switch may be turned on or off based on the first control signal CON1. The first switch may transfer the sensing bias voltage VBS to the anode of the organic light emitting diode OLED when being turned on. The second switch may be turned on or off based on the second control signal CON2. The second switch may transfer the deterioration sensing voltage VSET to the anode of the organic light emitting diode OLED when being turned on. In the display mode, the first switch may be turned off and the second switch may be turned off. In the deterioration sensing mode, the first switch may be turned on and the second switch may be turned off during the first time, and the first switch may be turned off and the second switch may be turned on during the second time following the first time.

In an example embodiment, as illustrated in FIG. 7, each of the pixel circuits 311 included in the display panel 310 may include a first transistor PT1, a second transistor PT2, a third transistor PT3, a fourth transistor PT4, a fifth transistor PT5, a sixth transistor PT6, a seventh transistor PT7, a eighth transistor PT8, a ninth transistor PT9, a storage capacitor CST, and an organic light emitting diode OLED. That is, each of the pixel circuits 311 included in the display panel 310 may have a 9T-1C structure (i.e., a structure including nine transistors and one capacitor). In the display mode, each of the pixel circuits 311 included in the display panel 310 may sequentially perform an initializing operation, a threshold voltage compensating operation, and a data writing operation based on voltage level changes of an initialization signal GI, a bias signal GB, a scan signal GW, and an emission control signal EM and then may control a driving current to flow through the organic light emitting diode OLED in response to a threshold voltage compensated data signal of the data signal VDATA stored in the storage capacitor CST. During the first time of the deterioration sensing mode, each of the pixel circuits 311 included in the display panel 310 may turn on the eighth transistor PT8 (i.e., the first switch) in response to the first control signal CON1 having a low voltage level and may turn off the ninth transistor PT9 (i.e., the second switch) in response to the second control signal CON2 having a high voltage level. Subsequently, during the second time of the deterioration sensing mode, each of the pixel circuits 311 included in the display panel 310 may turn off the eighth transistor PT8 (i.e., the first switch) in response to the first control signal CON1 having a high voltage level and may turn on the ninth transistor PT9 (i.e., the second switch) in response to the second control signal CON2 having a low voltage level. As a result, in the deterioration sensing mode, the temperature of the organic light emitting diode OLED may be raised because the sensing bias voltage VBS is applied to the organic light emitting diode OLED before the deterioration sensing voltage VSET is applied to the organic light emitting diode OLED. Thus, the deterioration of the organic light emitting diode OLED included in each of the pixel circuits 311 may be accurately sensed regardless of the temperature and/or the surrounding environment. Although it is illustrated in FIG. 7 that the first through ninth transistors PT1 through PT9 are PMOS transistors, in some example embodiments, the first through ninth transistors PT1 through PT9 may be NMOS transistors.

In an example embodiment, as illustrated in FIG. 8, each of the pixel circuits 311 included in the display panel 310 may include a first transistor NT1, a second transistor NT2, a third transistor NT3, a fourth transistor NT4, a storage capacitor CST, and an organic light emitting diode OLED. That is, each of the pixel circuits 311 included in the display panel 310 may have a 4T-1C structure (i.e., a structure including four transistors and one capacitor). In the display mode, each of the pixel circuits 311 included in the display panel 310 may perform a data writing operation based on a scan signal GW and then may control a driving current to flow through the organic light emitting diode OLED in response to the data signal VDATA stored in the storage capacitor CST. During the first time of the deterioration sensing mode, each of the pixel circuits 311 included in the display panel 310 may turn on the third transistor NT3 (i.e., the first switch) in response to the first control signal CON1 having a high voltage level and may turn off the fourth transistor NT4 (i.e., the second switch) in response to the second control signal CON2 having a low voltage level. Subsequently, during the second time of the deterioration sensing mode, each of the pixel circuits 311 included in the display panel 310 may turn off the third transistor NT3 (i.e., the first switch) in response to the first control signal CON1 having a low voltage level and may turn on the fourth transistor NT4 (i.e., the second switch) in response to the second control signal CON2 having a high voltage level. As a result, in the deterioration sensing mode, the temperature of the organic light emitting diode OLED may be raised because the sensing bias voltage VBS is applied to the organic light emitting diode OLED before the deterioration sensing voltage VSET is applied to the organic light emitting diode OLED. Thus, the deterioration of the organic light emitting diode OLED included in each of the pixel circuits 311 may be accurately sensed regardless of the temperature and/or the surrounding environment. Although it is illustrated in FIG. 8 that the first through fourth transistors NT1 through NT4 are NMOS transistors, in some example embodiments, the first through fourth transistors NT1 through NT4 may be PMOS transistors. Since a structure of the pixel circuit 311 shown in FIGS. 7 and 8 is an example, the structure of the pixel circuit 311 (i.e., a structure of the organic light emitting diode driving block included in the pixel circuit 311) may be changed according to requirements for the pixel circuit 311.

Figure 9:
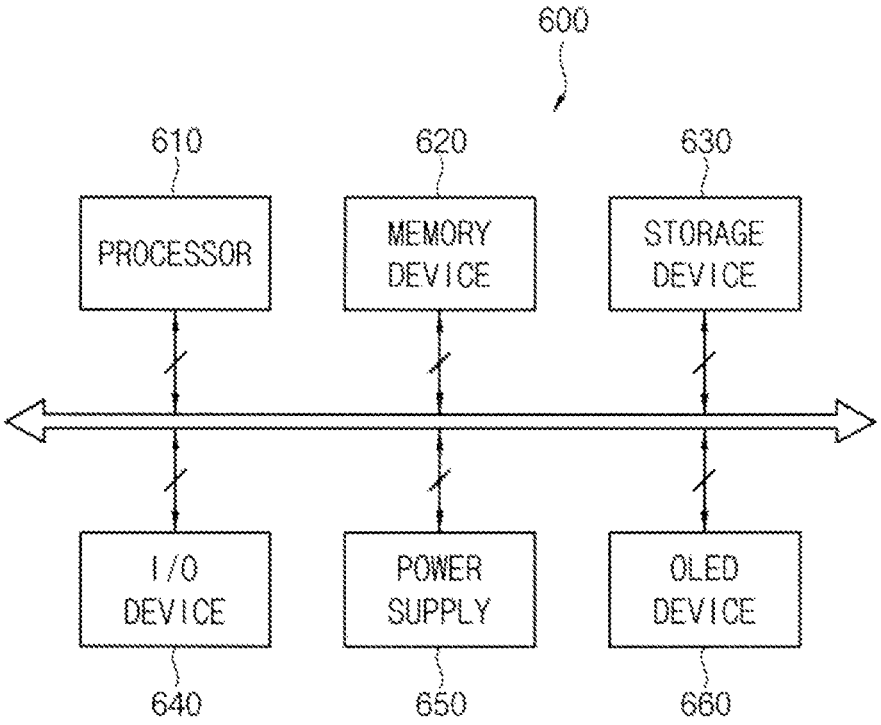
FIG. 9 is a block diagram illustrating an electronic device according to example embodiments.
Figure 10A:
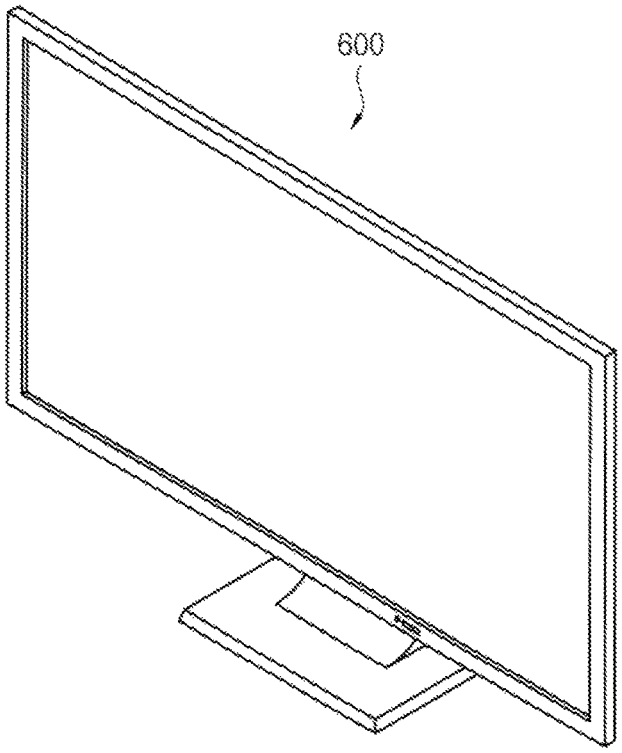
FIG. 10A is a diagram illustrating an example in which the electronic device of FIG. 9 is implemented as a television.
Figure 10B:
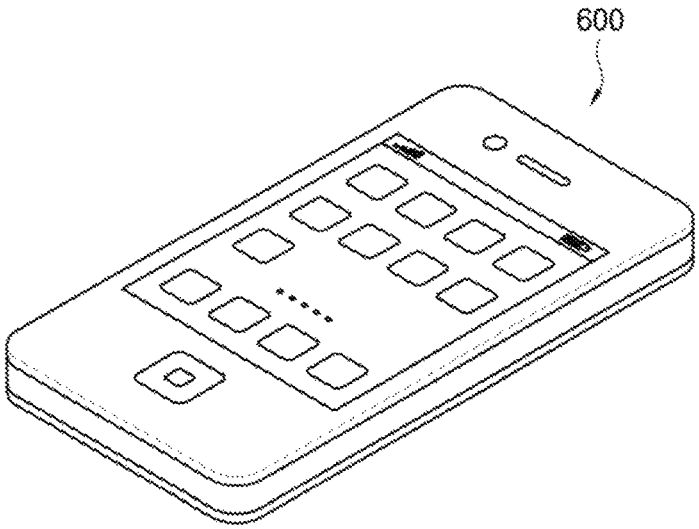
FIG. 10B is a diagram illustrating an example in which the electronic device of FIG. 9 is implemented as a smartphone.

FIG. 9 is a block diagram illustrating an electronic device according to example embodiments. FIG. 10A is a diagram illustrating an example in which the electronic device of FIG. 9 is implemented as a television. FIG. 10B is a diagram illustrating an example in which the electronic device of FIG. 9 is implemented as a smart-phone.

Referring to FIGS. 9 through 10B, the electronic device 600 may include a processor 610, a memory device 620, a storage device 630, an input/output (I/O) device 640, a power supply 650, and an organic light emitting display (OLED) device 660. Here, the organic light emitting display device 660 may be the organic light emitting display device 300 of FIG. 6. In addition, the electronic device 600 may further include a plurality of ports for communicating with a video card, a sound card, a memory card, a universal serial bus (USB) device, other electronic devices, etc. In an example embodiment, as illustrated in FIG. 10A, the electronic device 600 may be implemented as a television. In another example embodiment, as illustrated in FIG. 10B, the electronic device 600 may be implemented as a smart-phone. However, the electronic device 600 is not limited thereto. For example, the electronic device 600 may be implemented as a cellular phone, a video phone, a smart pad, a smart watch, a tablet PC, a car navigation system, a computer monitor, a laptop, a head mounted display (HMD) device, etc.

The processor 610 may perform various computing functions. The processor 610 may be a micro processor, a central processing unit (CPU), an application processor (AP), etc. The processor 610 may be coupled to other components via an address bus, a control bus, a data bus, etc. Further, the processor 610 may be coupled to an extended bus such as a peripheral component interconnection (PCI) bus. The memory device 620 may store data for operations of the electronic device 600. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 630 may include a solid state drive (SSD) device, a hard disk drive (HDD) device, a CD-ROM device, etc. The I/O device 640 may include an input device such as a keyboard, a keypad, a touchpad, a touch-screen, a mouse device, etc, and an output device such as a printer, a speaker, etc. In some example embodiments, the organic light emitting display device 660 may be included in the I/O device 640. The power supply 650 may provide power for operations of the electronic device 600.

The organic light emitting display device 660 may communicate with other components via the buses or other communication links. As described above, the organic light emitting display device 660 may accurately sense deterioration of an organic light emitting diode included in a pixel circuit regardless of a temperature and/or a surrounding environment by raising a temperature of the organic light emitting diode by applying a sensing bias voltage to the organic light emitting diode before applying a deterioration sensing voltage in a deterioration sensing mode. Thus, the organic light emitting display device 660 may provide a high-quality image to a viewer by accurately compensating for the deterioration of the organic light emitting diode regardless of the temperature and/or the surrounding environment. For this operation, the organic light emitting display device 660 may include a display panel, a scan driving part, a data driving part, a deterioration compensating part, and a timing control part. The display panel may include a plurality of pixel circuits each including the organic light emitting diode. In an example embodiment, each of the pixel circuits may include the organic light emitting diode, an organic light emitting diode driving block, a first switch, and a second switch. The organic light emitting diode driving block may be connected between an anode of the organic light emitting diode and a high power voltage. The organic light emitting diode driving block may control a driving current flowing through the organic light emitting diode based on a data signal applied via a data-line. The first switch may be turned on or off based on a first control signal. The first switch may transfer the sensing bias voltage to the anode of the organic light emitting diode when being turned on. The second switch may be turned on or off based on a second control signal. The second switch may transfer the deterioration sensing voltage to the anode of the organic light emitting diode when being turned on. In a display mode, the first switch may be turned off and the second switch may be turned off. In a deterioration sensing mode, the first switch may be turned on and the second switch may be turned off during a first time, and the first switch may be turned off and the second switch may be turned on during a second time following the first time. The scan driving part may provide a scan signal to the display panel. The data driving part may provide the data signal to the display panel. The deterioration compensating part may control a sensing bias current to flow through the organic light emitting diode during the first time, and may control a deterioration sensing current to flow through the organic light emitting diode during the second time in the deterioration sensing mode. The deterioration compensating part may determine the deterioration of the organic light emitting diode by comparing the deterioration sensing current with a predetermined sensing reference current and may generate deterioration compensation information for compensating for the deterioration of the organic light emitting diode. The timing control part may control the scan driving part, the data driving part, and the deterioration compensating part. The timing control part may compensate image data corresponding to the data signal based on the deterioration compensation information. Since the organic light emitting display device 660 is described above, duplicated description related thereto will not be repeated.

The present inventive concept may be applied to an organic light emitting display device and an electronic device including the organic light emitting display device. For example, the present inventive concept may be applied to a cellular phone, a smart phone, a video phone, a smart pad, a smart watch, a tablet PC, a car navigation system, a television, a computer monitor, a laptop, a head mounted display device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A pixel circuit comprising:

an organic light emitting diode having an anode and a cathode, the cathode being connected to a low power voltage;

an organic light emitting diode driving block connected between the anode of the organic light emitting diode and a high power voltage and configured to control a driving current flowing through the organic light emitting diode based on a data signal applied via a data-line;

a first switch configured to be turned on or off in response to a first control signal and to transfer a sensing bias voltage to the anode of the organic light emitting diode when being turned on; and a second switch configured to be turned on or off in response to a second control signal and to transfer a deterioration sensing voltage to the anode of the organic light emitting diode when being turned on, wherein, in a display mode, the first and second switches are turned off, and wherein, in a deterioration sensing mode, the first switch is turned on and the second switch is turned off during a first time, and the first switch is turned off and the second switch is turned on during a second time following the first time.

2. The pixel circuit of claim 1, wherein the second switch is connected between the data-line and the anode of the organic light emitting diode, and wherein the deterioration sensing voltage is applied via the data-line during the second time of the deterioration sensing mode.

3. The pixel circuit of claim 2, wherein the first and second switches are implemented by p-channel metal oxide semiconductor (PMOS) transistors, wherein the first switch is turned on when the first control signal has a low voltage level, and the second switch is turned on when the second control signal has the low voltage level, and wherein the first switch is turned off when the first control signal has a high voltage level, and the second switch is turned off when the second control signal has the high voltage level.

4. The pixel circuit of claim 2, wherein the first and second switches are implemented by n-channel metal oxide semiconductor (NMOS) transistors, wherein the first switch is turned on when the first control signal has a high voltage level, and the second switch is turned on when the second control signal has the high voltage level, and wherein the first switch is turned off when the first control signal has a low voltage level, and the second switch is turned off when the second control signal has the low voltage level.

5. The pixel circuit of claim 1, wherein a sensing bias current that is generated based on the sensing bias voltage applied to the anode of the organic light emitting diode and the low power voltage applied to the cathode of the organic light emitting diode flows through the organic light emitting diode during the first time of the deterioration sensing mode.

6. The pixel circuit of claim 5, wherein the first time of the deterioration sensing mode is set to be longer than or equal to a time during which a temperature of the organic light emitting diode reaches a predetermined sensing reference temperature as the sensing bias current flows through the organic light emitting diode.

7. The pixel circuit of claim 1, wherein a deterioration sensing current that is generated based on the deterioration sensing voltage applied to the anode of the organic light emitting diode and the low power voltage applied to the cathode of the organic light emitting diode flows through the organic light emitting diode during the second time of the deterioration sensing mode.

8. The pixel circuit of claim 7, wherein the second time of the deterioration sensing mode is a time generated by subtracting the first time of the deterioration sensing mode from a predetermined sensing allowable time for sensing deterioration of the organic light emitting diode.

9. An organic light emitting display device comprising:

a display panel including a plurality of pixel circuits each including an organic light emitting diode;

a scan driving part configured to provide a scan signal to the display panel;

a data driving part configured to provide a data signal to the display panel;

a deterioration compensating part configured to control a sensing bias current to flow through the organic light emitting diode during a first time, to control a deterioration sensing current to flow through the organic light emitting diode during a second time following the first time, to determine deterioration of the organic light emitting diode by comparing the deterioration sensing current with a predetermined sensing reference current, and to generate deterioration compensation information for compensating for the deterioration of the organic light emitting diode in a deterioration sensing mode; and a timing control part configured to control the scan driving part, the data driving part, and the deterioration compensating part and to compensate image data corresponding to the data signal based on the deterioration compensation information.

10. The display device of claim 9, wherein the deterioration compensating part is implemented inside the timing control part or the data driving part.

11. The display device of claim 9, wherein the deterioration sensing mode is executed at a time point when the display panel is powered on or off.

12. The display device of claim 9, wherein, in the deterioration sensing mode, the deterioration compensating part generates the deterioration compensation information for all of the plurality of pixel circuits or generates the deterioration compensation information for some of the pixel circuits.

13. The display device of claim 9, wherein each of the plurality of pixel circuits includes:

the organic light emitting diode having an anode and a cathode that is connected to a low power voltage;

an organic light emitting diode driving block connected between the anode of the organic light emitting diode and a high power voltage and configured to control a driving current flowing through the organic light emitting diode based on the data signal applied via a data-line;

a first switch configured to be turned on or off in response to a first control signal and to transfer a sensing bias voltage to the anode of the organic light emitting diode when being turned on; and a second switch configured to be turned on or off in response to a second control signal and to transfer a deterioration sensing voltage to the anode of the organic light emitting diode when being turned on, wherein, in a display mode, the first and second switches are turned off, and wherein, in the deterioration sensing mode, the first switch is turned on and the second switch is turned off during the first time, and the first switch is turned off and the second switch is turned on during the second time.

14. The display device of claim 13, wherein the second switch is connected between the data-line and the anode of the organic light emitting diode, and wherein the deterioration sensing voltage is applied via the data-line during the second time of the deterioration sensing mode.

15. The display device of claim 14, wherein the first and second switches are implemented by p-channel metal oxide semiconductor (PMOS) transistors, wherein the first switch is turned on when the first control signal has a low voltage level, and the second switch is turned on when the second control signal has the low voltage level, and wherein the first switch is turned off when the first control signal has a high voltage level, and the second switch is turned off when the second control signal has the high voltage level.

16. The display device of claim 14, wherein the first and second switches are implemented by n-channel metal oxide semiconductor (NMOS) transistors, wherein the first switch is turned on when the first control signal has a high voltage level, and the second switch is turned on when the second control signal has the high voltage level, and wherein the first switch is turned off when the first control signal has a low voltage level, and the second switch is turned off when the second control signal has the low voltage level.

17. The display device of claim 13, wherein the sensing bias current that is generated based on the sensing bias voltage applied to the anode of the organic light emitting diode and the low power voltage applied to the cathode of the organic light emitting diode flows through the organic light emitting diode during the first time of the deterioration sensing mode.

18. The display device of claim 17, wherein the first time of the deterioration sensing mode is set to be longer than or equal to a time during which a temperature of the organic light emitting diode reaches a predetermined sensing reference temperature as the sensing bias current flows through the organic light emitting diode.

19. The display device of claim 13, wherein the deterioration sensing current that is generated based on the deterioration sensing voltage applied to the anode of the organic light emitting diode and the low power voltage applied to the cathode of the organic light emitting diode flows through the organic light emitting diode during the second time of the deterioration sensing mode.

20. The display device of claim 19, wherein the second time of the deterioration sensing mode is a time generated by subtracting the first time of the deterioration sensing mode from a predetermined sensing allowable time for sensing the deterioration of the organic light emitting diode.

* * * * *